US005125643A

United States Patent [19]

Chung et al.

[11] Patent Number: 5,125,643

[45] Date of Patent: Jun. 30, 1992

[54] TRANSFER WHEEL OF COMPACT SORTER FOR COPY MACHINE

[75] Inventors: Jae H. Chung, Uijongbu; Yeon K. Jung, Bucheonsi, both of Rep. of Korea

[73] Assignee: Sindo Ricoh Co., Ltd., Seoul, Rep. of Korea

[21] Appl. No.: 714,433

[22] Filed: Jun. 13, 1991

[30] Foreign Application Priority Data

Mar. 12, 1991 [KR] Rep. of Korea ..... 1991-3951

[51] Int. Cl.[5] ..... B65H 39/10

[52] U.S. Cl. ..... 271/293; 271/294

[58] Field of Search ..... 271/293, 294, 279, 287

[56] References Cited

U.S. PATENT DOCUMENTS

| | | | |
|---|---|---|---|
| 4,220,325 | 9/1980 | Tates et al. | 271/294 X |
| 4,433,837 | 2/1984 | Romanowski | 271/294 X |
| 4,878,660 | 11/1989 | Irie | 271/293 |
| 5,048,820 | 9/1991 | Chung et al. | 271/293 |

FOREIGN PATENT DOCUMENTS

| | | | |
|---|---|---|---|
| 212555 | 12/1983 | Japan | 271/293 |
| 118573 | 6/1985 | Japan | 271/293 |
| 223764 | 11/1985 | Japan | 271/243 |

*Primary Examiner*—Robert P. Olszewski
*Assistant Examiner*—Boris Milef
*Attorney, Agent, or Firm*—Darby & Darby

[57] ABSTRACT

A transfer wheel of a sorter for transferring bin trays, each have a pair of pin trays, sequentially, comprises a transfer wheel body having three slots arranged at 120 degree angles around a central rotating shaft hole of the transfer wheel, and having a guide portion for guiding the pin trays of the bin tray. The transfer wheel also includes three pairs of insert wheels, each pair comprising two types of insert wheels mounted adjacent each other, between the slots in order to alternatively lift and push the pin tray to move the slot liner of a side plate. Further included is a mounting arrangement for mounting the insert wheels on the wheel body, and driving arrangement for rotating the wheel body. The invention provides a quiet transfer wheel which separates copies at every one-third rotation of the wheel, which causes an upper and a lower waiting pin tray to be positioned within the radius of rotation of the wheel. The invention uses either a rack style, a wire style, or a spring style device to support the bin tray.

11 Claims, 14 Drawing Sheets

TRANSFER WHEEL OF COMPACT SORTER FOR COPY MACHINE

BACKGROUND OF THE INVENTION

1. Field of The Invention

The present invention relates to transfer wheel of a compact sorter for copy machine, and more particularly to a transfer wheel mounted at side plate near the inclined middle portion of the slot liner extending toward the ejecting section of the copy machine and adapted for sequentially transferring the bin trays for receiving copies.

2. Description of The Prior Art

Generally, a known sorter for copy machine has been provided with a slot liner and a transfer wheel in order to sequentially transfer bin trays each having a pair of pin trays an adapted for separately receiving copies.

For example, U.S. Pat. No. 4,328,963 disclosed a sorter for copy machine provided with a circular transfer wheel having a slot, and U.S. Pat. Nos. 4,379,361 and 4,466,608 respectively disclosed another types of sorters each provided with a circular transfer wheel having first and second slots arranged along a diameter of said transfer wheel and extending radially inward from a circumference of said transfer wheel. In the known sorters of these types, the bin tray was generally transferred upwardly and downwardly along the vertical linear slot liner within the radius of gyration of the transfer wheel so that there might be a certain gap between the bin tray and the ejecting section of the copy machine. Therefore, it has been noted that this type of sorter had the structural disadvantage of requiring an auxiliary units for stably receiving the copies from the ejecting section of the copy machine.

In an effort for solving the above-mentioned disadvantages, there has been proposed a compact sorter provided with a slot liner having an inclined portion as disclosed in Korean Patent Application No. 90-855 which was applied by this applicant. However, this type of sorter also had the disadvantage of requiring the relatively larger power for smoothly driving the conventional circular transfer wheel, further of generating the noise.

Therefore, this applicant has also proposed a sorter provided with a transfer wheel having an improved structure as disclosed in Korean Patent Application No. 90- 15,404. The transfer wheel of this type of sorter had a pair of partially elliptic surfaces each provided around the portion of the slot in order to reduce the noise and the load, as shown in accompanying drawings, FIGS. 1A and 1B. However, it has been noted that there were disadvantages of spending a long time for separating the copies so that it could separate copies only two times during one rotation of the transfer wheel, and necessary of an auxiliary units for usually urging the bin tray upwardly, such as a spring and the like.

Also, Korean Patent Application No. 90-18264 disclosed a sorter provided with a transfer wheel having three slots instead of the above-mentioned transfer wheel having two slots, as shown in FIG. 2, the sorter of this type could carry out one transferring operation for the bin tray during one third cycle of rotation of the transfer wheel as a result of the three slots each arranged at every 120° on the transfer wheel and extending radially inward from a circumference of said transfer wheel, and also transfer slowly and upwardly another lower waiting bin tray according to the driving rate of the transfer wheel because the transfer wheel was provided with involute portions each formed at sections which might contact with the pin tray of the bin tray so that a waiting pin tray could be smoothly and naturally located within the radius of gyration of said transfer wheel. Thus, this type of transfer wheel could be applied to various types of sorters provided with biasing units for urging the bin tray upwardly, said biasing units using a spring, a wire, a rack or a supporting mechanism.

However, the above-mentioned type of sorter had the transfer wheel comprising an integrally formed rotator and the slots formed on the rotator so that it could not secure an effect as well as that of the sorter disclosed in Korean Patent Application No. 90-15,404 during the operations of upward and downward movements of the bin tray. Furthermore, there has been a disadvantage of enlarging the noise because of adding a noise generated while a bin tray seated on the upper portion of the transfer wheel was instantaneously received in a slot of said transfer wheel to the noise generated by the overload during driving said transfer wheel.

In addition, Japanese Patent No. sho. 60-232,370 disclosed a sorter provided with a transfer wheel having a pair of slots each comprising two slot surfaces, a first surface comprising a circular slot surface and a second surface comprising a protrusion adapted for picking up the pin tray and formed as protruding out of the radius of gyration of said circular surface at a part of the thick of said transfer wheel. However, this type of transfer wheel also had disadvantages that it required an auxiliary cam device for driving the protrusion, and a tension spring for urging the bin tray upwards. Furthermore, it has been noted that there was another disadvantages of overload during urging upward the pin tray picked up by the slot and necessary of an auxiliary driving device for driving the bin tray to move horizontally during receiving the copies.

SUMMARY OF THE INVENTION

It is, therefore, an object of the present invention to provide a transfer wheel for sorter, which transfer wheel comprising a wheel body capable of changing its surface contacting with the pin tray of the bin tray within the radius of gyration of the transfer wheel according to the rotational direction and rotating position thereof and having elliptic circumferencial surfaces, thereby reducing the noise and the load.

It is another object of the present invention to provide a transfer wheel for sorter having three slots each arranged at every 120° angle centering around a center rotating shaft hole of the transfer wheel and extending radially inward from a circumference of said transfer wheel body, thereby making it possible to separating copies at every one third rotation of the transfer wheel.

It is still another object of the present invention to provide a transfer wheel for sorter having elliptic portions at surfaces contacting with the waiting pin tray, thereby causing upper or lower waiting pin tray to be positioned within the radius of gyration of the transfer wheel.

It is still another object of the present invention to provide a transfer wheel for sorter capable of slowly transferring the pin tray upwardly according to the rotational rate of the transfer wheel so that the supporting device for supporting the bin tray may use the rack style device, wire style device beside the spring style device.

In accordance with the present invention, the above-mentioned objects can be accomplished by providing a transfer wheel of sorter for transferring bin trays each having a pair of pin trays, sequentially, said transfer wheel comprising: a transfer wheel body provided with three slots each arranged at every 120° angle centering around a center rotating shaft hole of said transfer wheel and having a guide portion for guiding said pin tray of the bin tray; three pairs of insert wheels, each pair comprising two types of insert wheels mounted near with each other between said slots in order to alternatively pick up and push said pin tray moving the slot liner of said side plate; a mounting means for mounting said insert wheels on said transfer wheel body; and driving means for providing a rotation power for said transfer wheel body.

BRIEF DESCRIPTION OF THE DRAWINGS

The above and other objects, features and other advantages of the present invention will be more clearly understood from the following detailed description taken in conjunction with the accompanying drawings, in which:

FIGS. 8B to 8D are views showing the ideal driving mechanism of pin tray during the rotation of the transfer wheel by comparing with known driving mechanism in order to representing the present invention;

DETAILED DESCRIPTION OF THE PREFERRED EMBODIMENTS

Figure 1A:
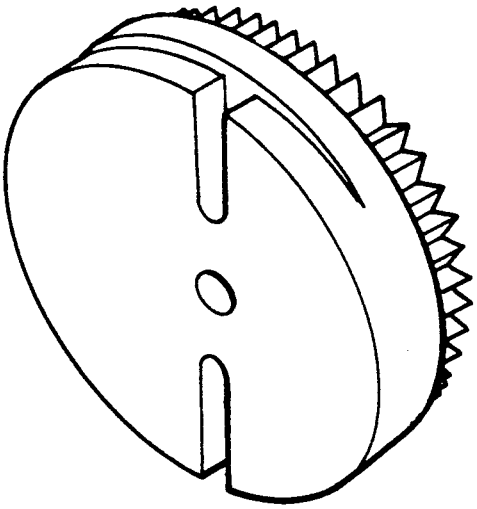
FIG. 1A (Prior Art)
FIGS. 1A, 1B and 2 are perspective views showing the known transfer wheels in accordance with the prior art, respectively.
Figure 1B:
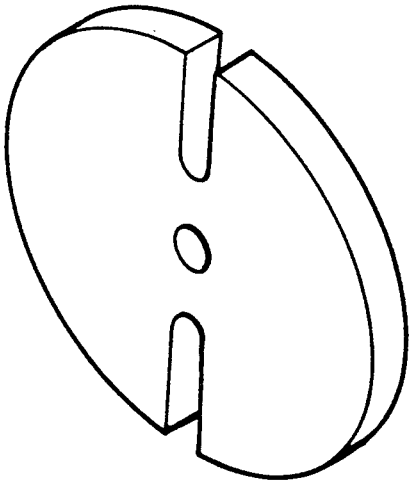
FIG. 1B (Prior Art)
Figure 2:
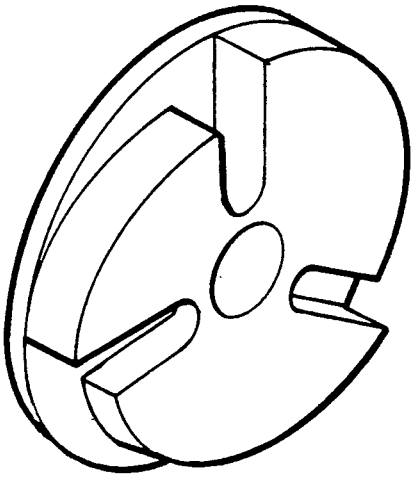
FIG. 2 (Prior Art)
Figure 3:
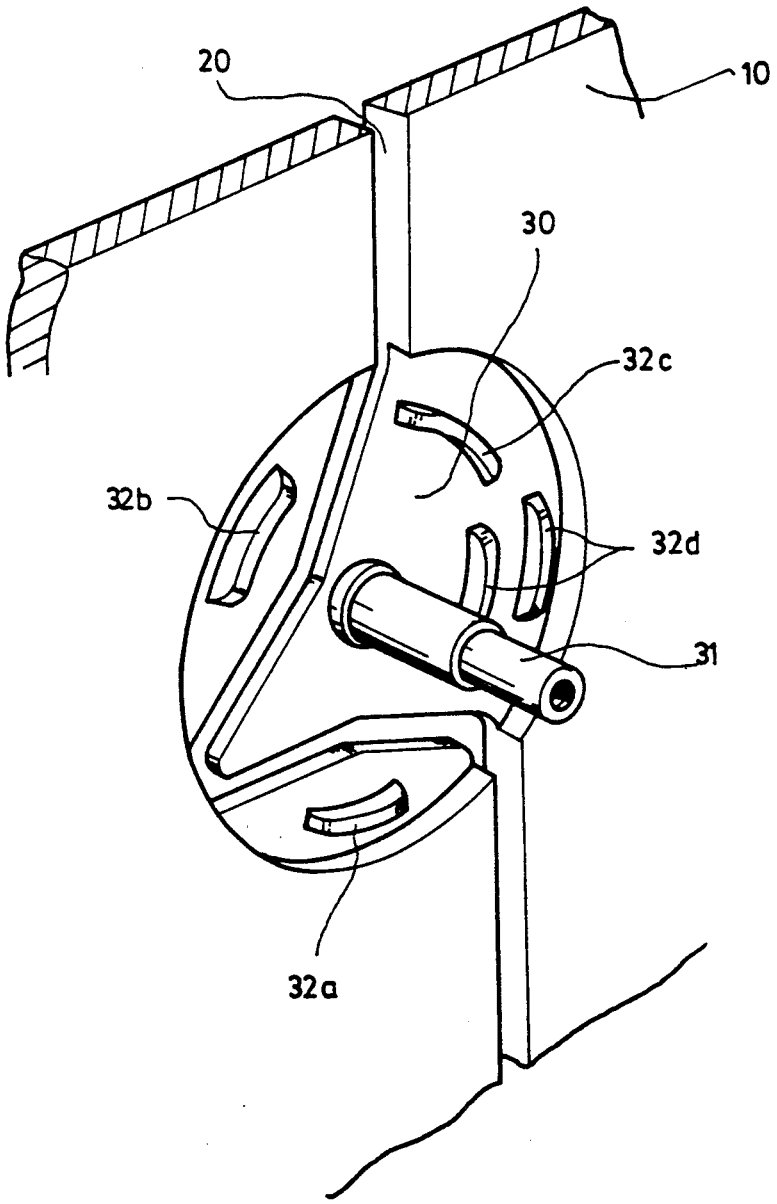
FIG. 3 is a perspective view of a side plate of sorter on which an embodiment of a transfer wheel in accordance with the present invention is mounted.
Figure 4:
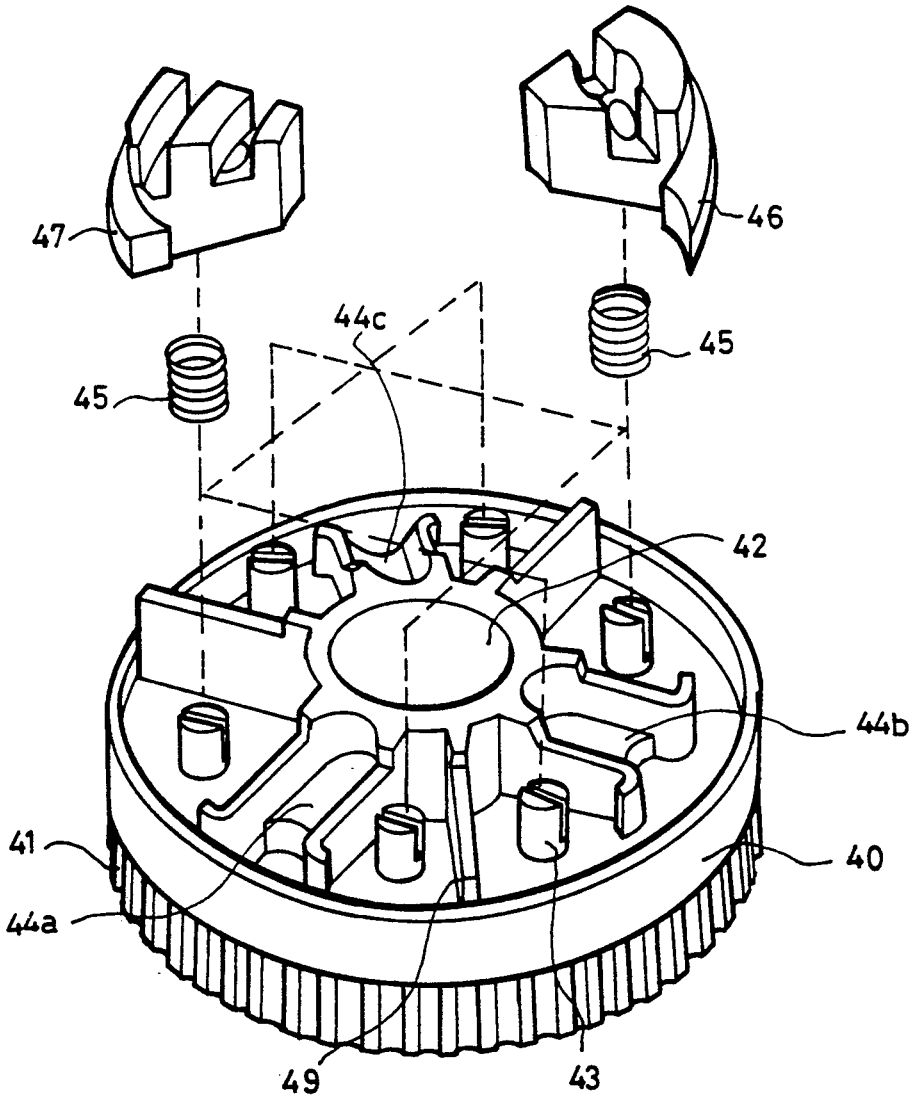
FIG. 4 is a broken and enlarged perspective view of the transfer wheel of the present invention.

Turning now to FIGS. 3 and 4 which are a perspective view of a side plate 10 of sorter on which an embodiment of a transfer wheel in accordance with the present invention is mounted and a broken perspective view of the transfer wheel of FIG. 3, respectively, the transfer wheel comprises a generally circular transfer wheel body 40 provided with three slots 44*a*, 44*b* and 44*c* each arranged at every 120° angle centering around a center rotating shaft hole 42 and extending radially inward from a circumference of said transfer wheel body 40. The transfer wheel body 40 is also provided with three pairs of first and second insert wheels 46 and 47 each pair located and spaced apart between two slots and spaced apart from each other, and three partitions 49 each formed between said insert wheels 46 and 47, said partition 49 having a height of preventing the contacting with a protrusion of the side plate 10 so that there may not be an interference therebetween during rotation of said insert wheels 46 and 47.

The first and second insert wheels 46, 47 each is inserted onto a insert wheel supporting shaft 43 formed as protruding on the surface of the body 40 and biased upwardly by a spring 45 interposed between said insert wheel 46, 47 and the body 40. Additionally, the insert wheels 46 and 47 comprise two wheels, a first wheel 46 simply passing a first pair of circumferencial wheel driving projections 32*b* and 32*c* provided on a wheel contacting surface 30 of said side plate 10, but retracted toward the wheel body 40 against the power of the spring 45 during contacting with a second pair of circumferencial wheel driving projections 32*a* and 32*d*, and a second wheel 47 simply passing the second pair of circumferencial wheel driving projections 32*a* and 32*d*, but retracted toward the wheel body 40 against the power of the spring 45 during contacting with the first pair of circumferencial wheel driving projections 32*b* and 32*c*.

In the drawings, the reference numerals 31 and 42 designate a transfer wheel supporting shaft and a center opening for receiving the rotational shaft, respectively.

Figure 5:
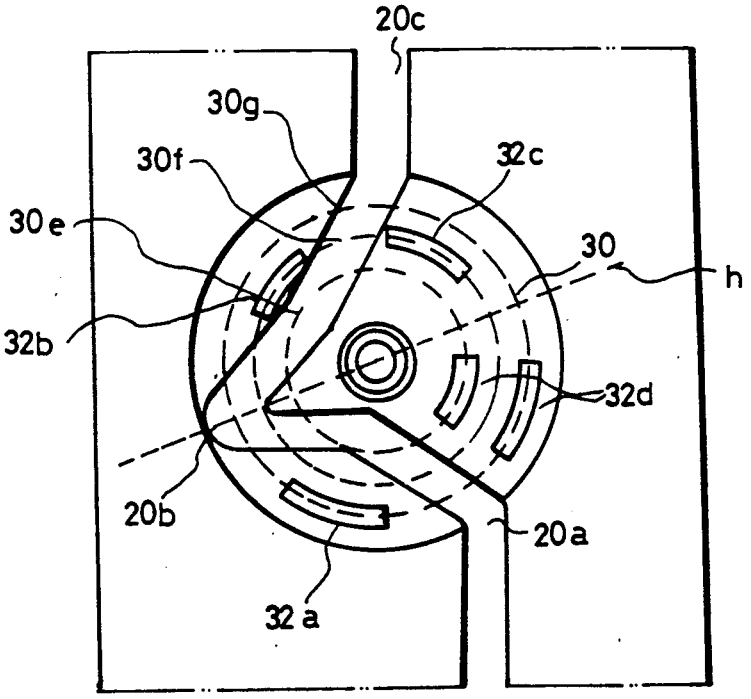
FIG. 5 is a partially enlarged plane view of the side plate of FIG. 3.

Turning next to FIG. 5 which is an enlarged view of the wheel contacting surface of the side plate 10, the side plate 10 has a slot liner 20 comprising upper and lower vertical portions 20*c* and 20*a* connected by a middle portion 20*b*, and a wheel contacting surface 30. Additionally, the wheel contacting surface 30 is provided with the second pair of wheel driving projections 32*a* and 32*d* fixed on first and third concentric circumferences 30*e* and 30*g* near the lower vertical portion 20*a* of the slot liner and the first pair of wheel driving projections 32*b* and 32*c* fixed on second concentric circumference 30*f* thereof near the upper vertical portion 20*c* of the slot liner.

Figure 6A:
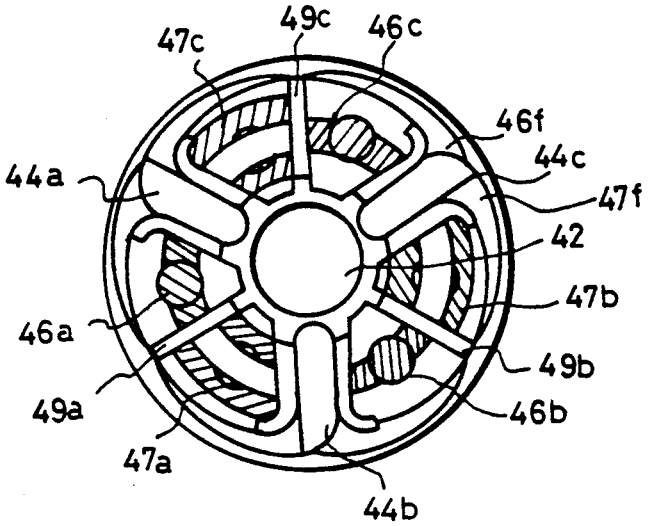
FIGS. 6A to 6D are views each showing detailed construction of two embodiments of a transfer wheel in accordance with the present invention.
Figure 6B:
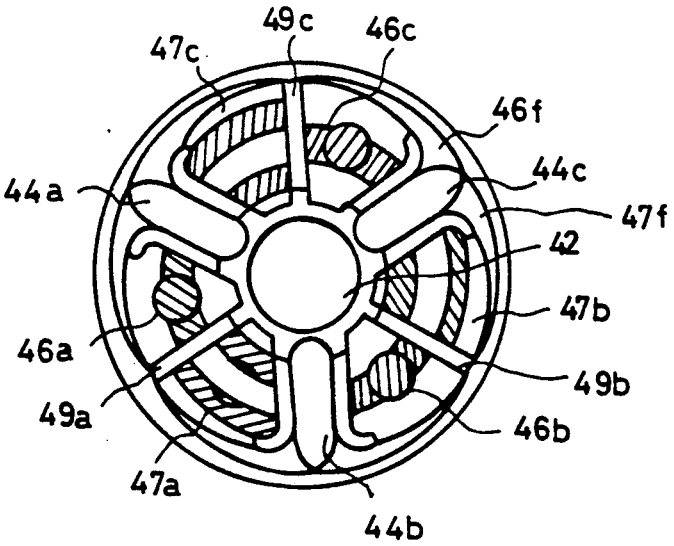

On the other hand, as shown in FIGS. 6A to 6D which are plane views of first and second embodiments of transfer wheel according to this invention, and side and rear views of the transfer wheels of FIGS. 6A and 6B, respectively, the first and second embodiments of transfer wheel each is provided with three slots 44*a*, 44*b* and 44*c* each arranged at every 120° angle centering around a center rotating shaft hole 42 and extending radially inward from a circumference of said transfer wheel body 40, three pairs of first and second insert wheels each pair located between two slots. Here, of the pair of insert wheels, the first insert wheels 46*a*, 46*b*, and 46*c*, are each is provided with a circumferential slot adapted for simply passing a first pair of circumferential projections 32*b* and 32*c* provided on the second concentric circumference 30*f* on the wheel contacting surface 30 of the side plate 10, but retracting said first insert wheels 46*a*, 46*b*, and 46*c* toward the wheel body 40 against the power of the spring 45 during contacting with a second pair of circumferencial wheel driving projections 32*a* and 32*d* on the first and third concentric circumferences 30*e* and 30*g* on the wheel contacting surface 30, and the second insert 47*a*, 47*b*, and 47*c* are each provided with a pair of circumferencial slots adapted for simply passing said second pair of circumferencial wheel driving projections 32*a* and 32*d*, but retracting said second insert wheel 47*b* toward the wheel body 40 against the power of the spring 45 during contacting with said first pair of circumferencial wheel driving projections 32b and 32c.

The two types of insert wheels 46a–c and 47a–c, therefore, continuously and alternatively reverse their positional states on the basis of the center line h shown in dotted line in FIG. 5. In result, all of the insert wheels 46a, 47a, 46b, 47b, 46c, 47c are individually driven in order to change the moving direction of the bin tray. In addition, the two types of insert wheels each is provided with elliptic outer surfaces e.g. 46a', 47a', and elliptic inner surfaces, e.g. 46a'' and 47a'', for guiding the pin tray of the bin tray, said inner surface 46a'', 47a'' inscribed in the slots 44a–c.

Figure 6C:
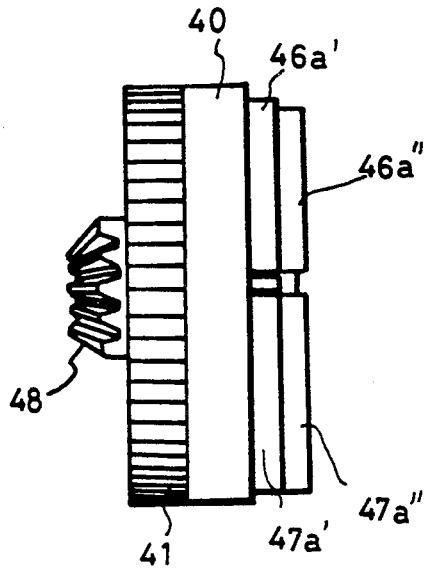
Figure 6D:
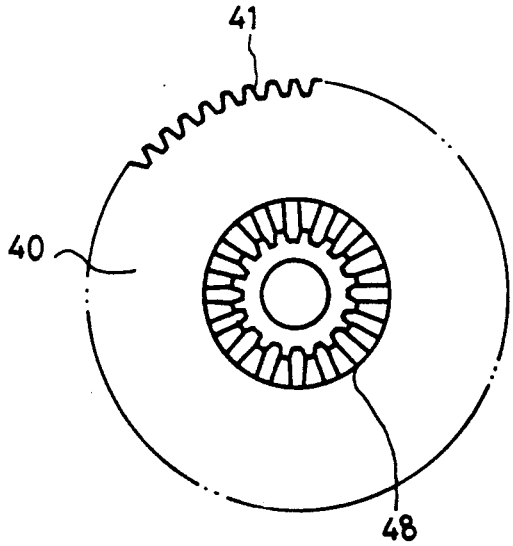

Also, as shown in FIGS. 6C and 6D, the transfer wheel body 40 may have a bevel gear shaft 48 integrally formed with the rear surface thereof and adapted for transmitting the rotation power from a motor (not shown) thereto, and a spur gear 41 formed around the circumferential surface thereof for transmitting the rotation power to the mechanism for transferring the bin tray.

The insert wheels 46 and 47 each has a tail portion 46f and 47f in order to form a slot, and said two tail portions may comprise a rounded extending tail portion 46f and a plane tail portion 47f as shown in FIG. 6A, or two rounded extending tails as shown in FIG. 6B.

FIGS. 7A to 7D show a third and fourth embodiments of a transfer wheel in accordance with the present invention, said types of transfer wheels capable of detecting a rotational position thereof and a position of the pin tray 50 during the upward and downward movements of said bin tray.

Generally, the above-mentioned transfer wheels of the two types shown in FIGS. 6 and 7 are mounted on the opposite side plates 10 of the sorter, respectively, in order to form a set of transfer wheels, thereby causing the pin trays to be transferred upward or downward along the slot liner, sequentially.

Figure 7A:
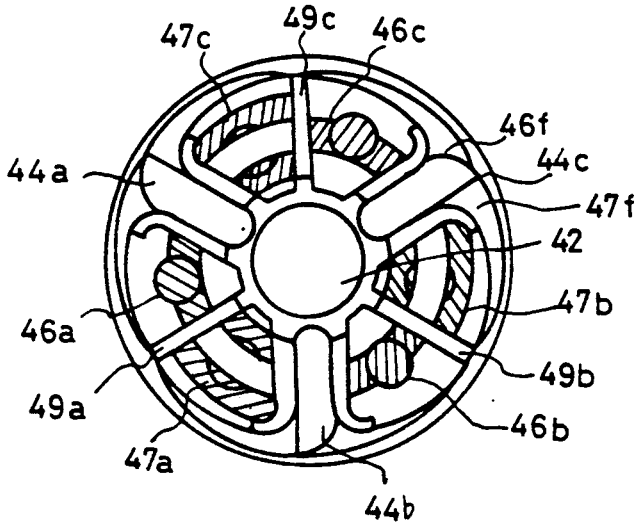
FIGS. 7A to 7D are views corresponding to FIGS. 6, but showing another two embodiments of the present invention.
Figure 7B:
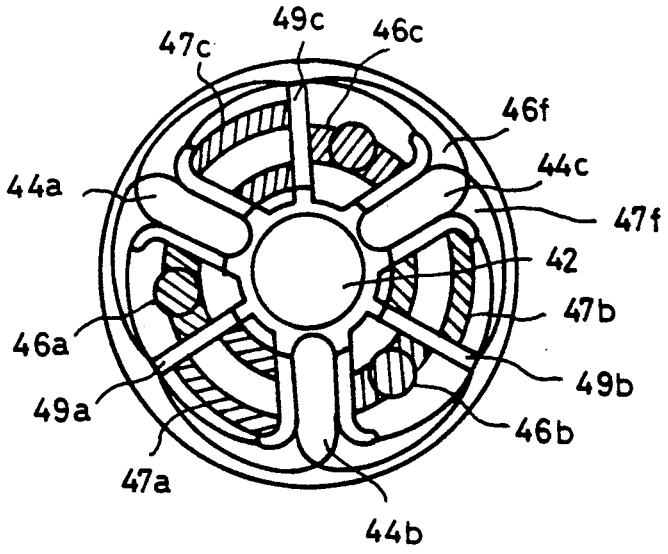
Figure 7C:
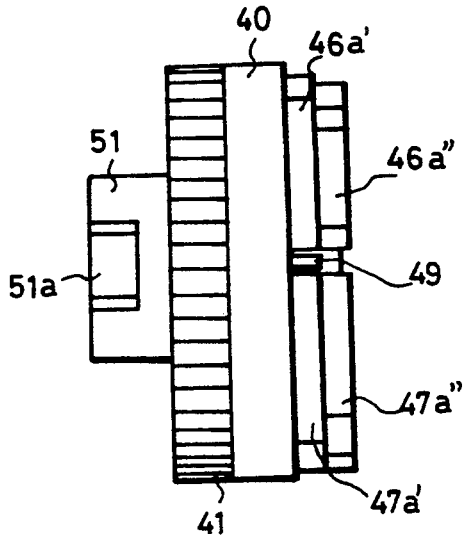
Figure 7D:
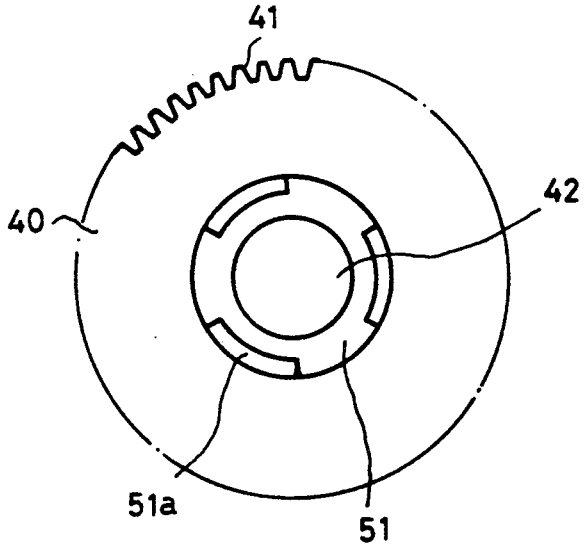

In the drawings, FIGS. 7A and 7B are respectively plane views of third and fourth embodiments of transfer wheel according to this invention, and FIGS. 7c and 7D are side and rear views of the transfer wheels of FIGS. 7A and 7B, respectively.

These types of transfer wheels shown in FIGS. 7A and 7B has the same planar structure as that of the transfer wheels shown in FIGS. 6A and 6B, thus the detailed description of the planar structure can be referred to that of the planar structure of the transfer wheels shown in FIGS. 6A and 6B, while the other structure thereof will be described as follows.

The transfer wheels of FIGS. 7 each is provided with a cylindrical rotation detecting shaft 51 integrally formed on the center of the rear surface of the wheel body 40 as shown in FIGS. 7C and 7D. The rotation detecting shaft 51 includes three detecting slots 51a which each is formed on the outer side surface thereof at every 120° angle centering around the center of the detecting shaft 51 and extending circumferencially, and adapted for turning on/off a microswitch (not shown) capable of detecting the one third rotation of the transfer wheel. On the other hand, the rotation detecting shaft 51 may have penetrated holes which each is formed on the outer side surface thereof at every 120° angle centering around the center of the detecting shaft 51, and adapted for turning on/off an optical-switch (not shown) capable of detecting the one third rotation of the transfer wheel.

In addition, these types of transfer wheels each is provided with a spur gear 41 formed on the outer side surface of the wheel body 40 and adapted to transmit the driving power to the transfer wheel.

It is possible to form the circumferencial slots of the insert wheels 46 and 47 as another styles within the function of providing the alternative positional displacement of the insert wheels.

The driving mechanism of the transfer wheel in accordance with the present invention will be more detailedly described in conjunction with FIGS. 8 which are views showing the ideal driving mechanism of the transfer wheel as follows.

Figure 8A:
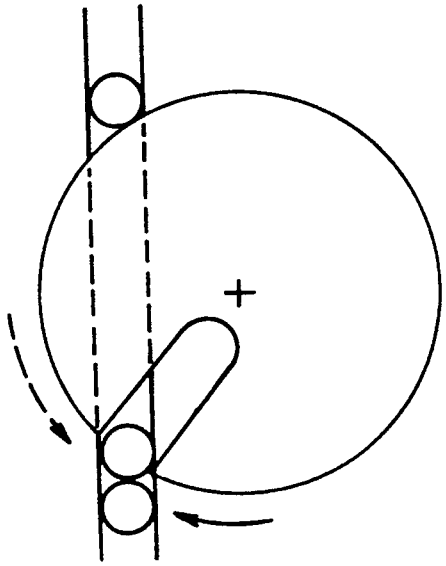
FIG 8A (Prior Art)
FIGS. 8A and 8C are views showing a known driving mechanism
Figure 8B:
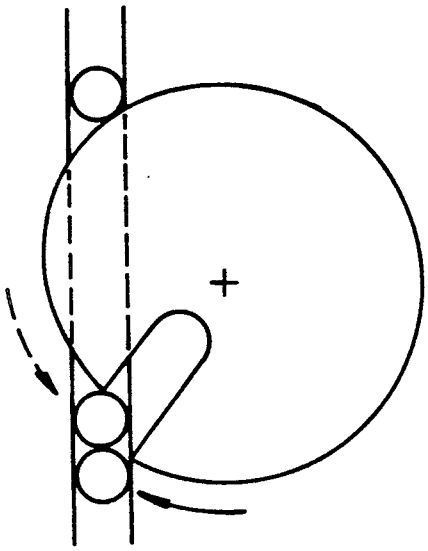
Figure 8C:
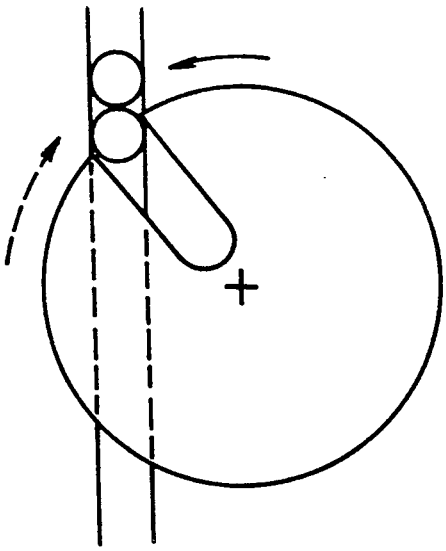
FIG. 8C (Prior Art)
Figure 8D:
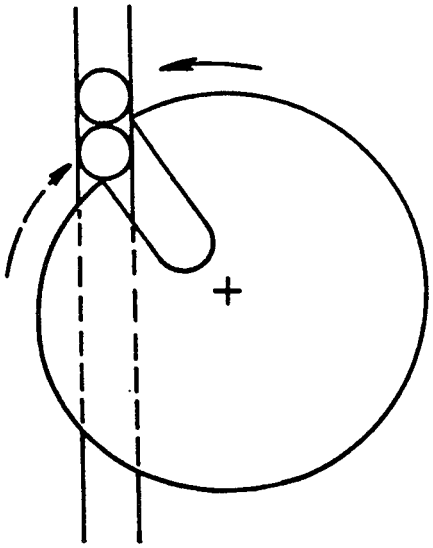

In picking up the pin tray of the bin tray upwardly in order to transferring the bin tray upwards as shown in FIG. 8A, and 8B the slot structure shown in FIG. 8B capable of providing a secured picking up because the pin tray 50 can be picked up after located within the slot may be better than that shown in FIG. 8A. On the contrary, In picking up the pin tray 50 of the bin tray downwardly in order to transferring the bin tray downwards as shown in FIGS. 8C and 8D slot structure shown in FIG. 8D capable of providing a secured picking up because the pin tray can be picked up after located within the slot may be better than that shown in FIG. 8C. Additionally, in pushing upwardly the picked up pin tray in order to allow the pin tray to escape from the slot as shown in FIGS. 8A and 8B, the slot structure shown in FIG. 8B capable of easily pushing the pin tray upwards by a relatively smaller power may be better than that shown in FIG. 8A. On the contrary, in pushing downwardly the picked up pin tray in order to allow the pin tray to escape from the slot as shown in FIGS. 8C and 8D, the slot structure shown in FIG. 8D capable of easily pushing the pin tray downwards by a relatively smaller power may be better than that shown in FIG. 8C.

However, the known transfer wheels having integrally formed structure according to prior art could not provide such structures shown in FIGS. 8B and 8D in a wheel body.

The present invention is, accordingly, provided with the above-mentioned six insert wheels which are included in the wheel body and capable of driving individually so that the above-described ideal driving mechanism can be provided and the disadvantage encountered in the known transfer wheel having the integrally formed structure can be solved.

Figure 9A:
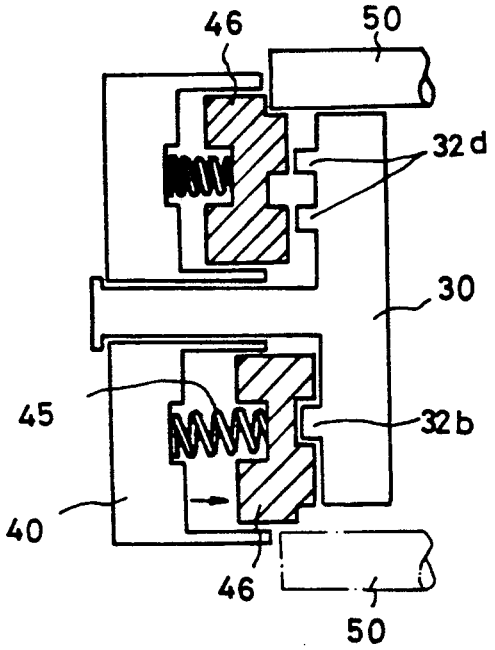
FIGS. 9A, 9B, 10A to 10C, 11A to 11D are views showing the pin tray transferring operation by the transfer wheel in accordance with the present invention, respectively.
Figure 9B:
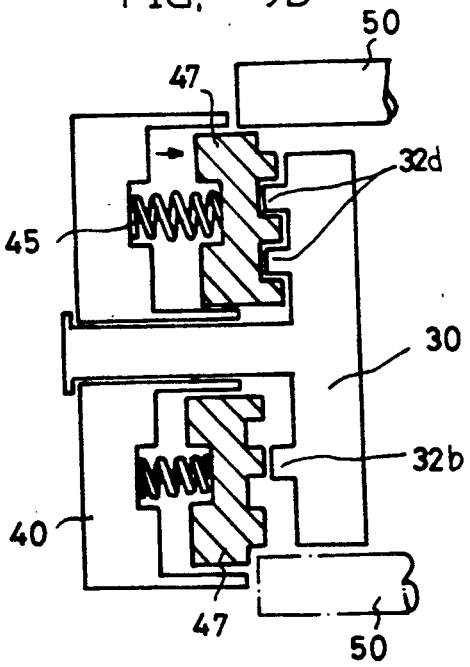

FIGS. 9A and 9B are side section views representing the operational states of the transfer wheel according to this invention, respectively. In these drawings, all the reference numerals except 50 denoting the pin tray of the bin tray are the same numerals as those of FIGS. 3 and 4.

The circumferencial wheel driving projections 32b and 32d of the side plate 10 of the sorter will engage with or push the insert wheels according to the interaction thereof with circumferencial slots of the insert wheels 46 and 47 during the rotation of the transfer wheel. That is to say, the insert wheel 47 having two circumferencial slots will be pushed against the spring power of the spring 45 by the circumferencial wheel driving projection 32b of the side plate 10 as it faces with said wheel driving projection 32b, but has no displacement as it faces with the circumferencial wheel driving projection 32d as shown in FIG. 9B.

Figure 10A:
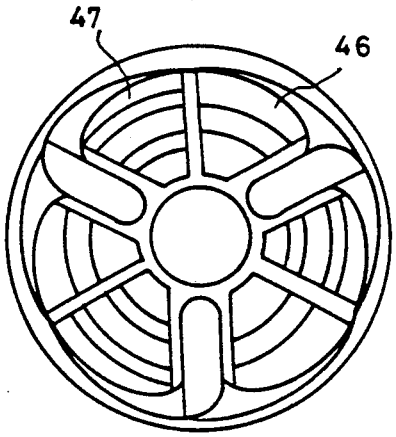
Figure 10B:
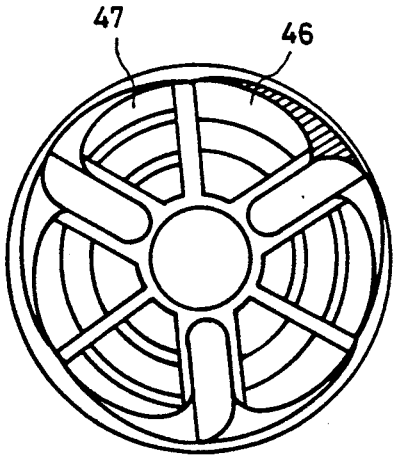
Figure 10C:
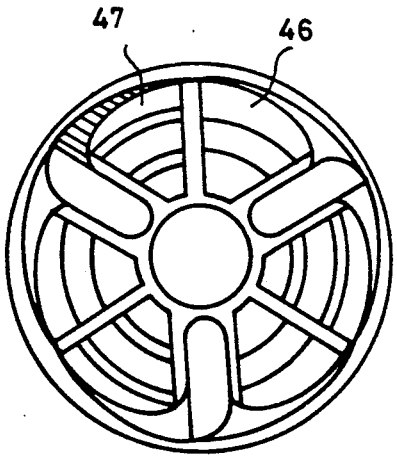

In the same manner, the insert wheel 46 having one circumferencial slot will be pushed against the spring power of the spring 45 by the circumferencial wheel driving projection 32*d* of the side plate 10 as it faces with said wheel driving projection 32*d*, but has no displacement as it faces with the circumferencial wheel driving projection 32*b* as shown in FIG. 9A. In result, the surface contacting with the pin tray 50 continuously changed as shown in FIGS. 10 which show that the surface contacting with the pin tray 50 continuously changed according to the interaction of the insert wheels 46 and 47 and the circumferencial wheel driving projections of the side plate 10 during the rotation of the transfer wheel.

The transfer wheel in a state in which the second insert wheel 47 having two circumferencial slots is pushed against the spring power of the spring 45 by the circumferencial wheel driving projection 32*b* of the side plate 10 as shown in FIG. 9B and the first insert wheel 46 having one circumferencial slot maintains its biased state by engaging with the circumferencial wheel driving projection 32*b* as shown in FIG. 9A, can transfer the pin tray along an inner passage (hatching portion in FIG. 10C, said portion corresponding to the elliptic inner surface 47*a*" shown in FIG. 6C) of the insert wheel 47. On the contrary, the transfer wheel in other state in which the insert wheels 46 and 47 are positioned in the reversed position from the above-mentioned position can transfer the pin tray along another inner passage (hatching portion in FIG. 10B, said portion corresponding to the elliptic inner surface 46*a*" shown in FIG. 6C) of the insert wheel 46. In result, the transfer wheel in accordance with this invention can provide such a driving mechanism shown in FIGS. 8B and 8D in a wheel body for the sorter.

The bin tray transferring operation by the transfer wheel according to this invention will be described in conjunction with FIGS. 11 as follows.

Figure 11A:
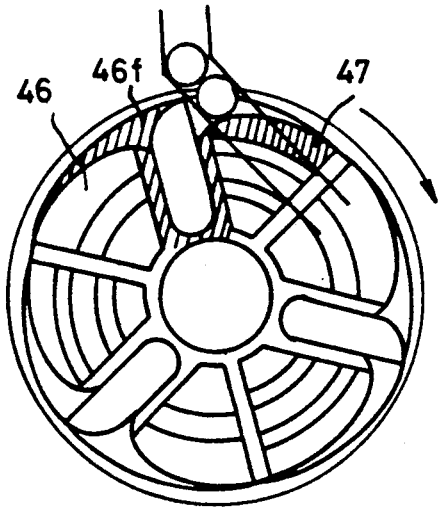
Figure 11B:
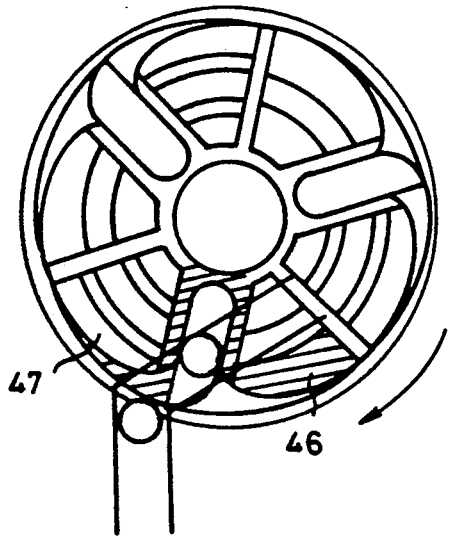

First, in picking up the bin trays downwardly, the transfer wheel having the first and second insert wheels 46 and 47, the first insert wheel 46 maintaining its biased position as a result of engaging with the circumferential wheel driving projection 32*b* and the second insert wheel 47 having two circumferential slots and being pushed against the spring power of the spring 45 by said circumferential wheel driving projection 32*b*, can pick up the lowermost pin tray of the pin trays positioned in the upper vertical portion of the slot liner out of the slot of the transfer wheel as shown in FIG. 11A. Thereafter, in allowing the picked up pin tray to be escaped out of the slot, the positional states of the insert wheels 46 and 47 are reversed as the transfer wheel rotates one third cycle of rotation, and the tail (outer passage) 47*f* of the second insert wheel 47 pushes downwards another pin tray already positioned in the lower end of the inclined middle of the slot liner in order to secure a space for newly receiving the picked up pin tray, thereby causing the picked up pin tray to be smoothly received into the space by the first insert wheel 46 as shown in FIG. 11B.

Figure 11C:
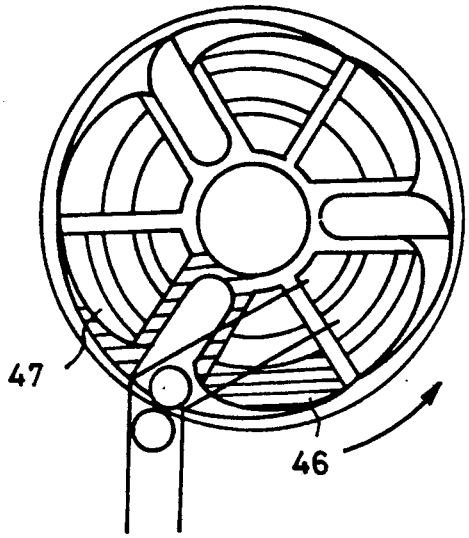
Figure 11D:
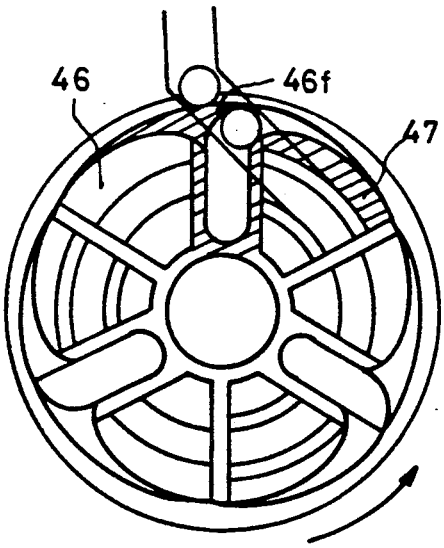

On the contrary, in picking up the bin trays upwardly, the transfer wheel having the insert wheels 46 and 47, the first insert wheel 46 having one circumferential slot and being pushed against the spring power of the spring 45 by the circumferencial wheel driving projection 32*d*, and the second insert wheel 47 having two circumferential slots and maintaining its biased position as a result of engaging with the circumferential wheel driving projection 32*d*, can pick up the uppermost pin tray of the pin trays positioned in the lower vertical portion of the slot liner out of the slot of the transfer wheel as shown in FIG. 11C. Thereafter, in allowing the picked up pin tray to be escaped out of the slot, the positional states of the first and second insert wheels 46 and 47 are reversed as the transfer wheel rotates one third cycle of rotation, and the tail (outer passage) 46*f* of the first insert wheel 46 pushes upwards another pin tray already positioned in the upper end of the inclined middle of the slot liner in order to secure a space for newly receiving the picked up pin tray, thereby causing the picked up pin tray to be smoothly received into the space by the second insert wheel 47 as shown in FIG. 11D. In addition, the transfer wheel pushes upwardly and smoothly the pin trays already positioned in the upper vertical portion of the slot liner by its own elliptic outer surface including the inner passage of the second insert wheel 47 as it rotates, thereby making it possible to reduce the load to the transfer wheel during picking up and pushing the pin tray.

On the other hand, the contacting surface with the pin tray provided by the first and second insert wheels 46 and 47 has the normally formed elliptic portion having a height difference (the maximum height difference between the outer passage and the inner passage) between the start point and the last point thereof, said height being equal to or relatively larger than the diameter of the pin tray.

The transfer wheel according to this invention can normally transfer the pin tray upwards or downwards so that the transferring device for transferring the whole bin tray may be applied with a rack device using the driving power from the transfer wheel, a wire device or a supporter device.

As above-mentioned, the present invention can provide the transfer wheel which can smoothly transfer the bin tray by small power and does not generate noise during picking up and pushing the pin tray in a moment because the pin tray can received by the gap provided by the tails 46*f* and 47*f* of the first and second transfer wheels 46 and 47.

Although the preferred embodiments of the present invention have been disclosed for illustrative purpose, those skilled in the art will appreciate that various modifications, additions and substitutions are possible, without departing from the scope and spirit of the invention as disclosed in the accompanying claims.

What is claimed is:

1. A transfer wheel of sorter for transferring bin trays each having a pair of pin trays, sequentially, said transfer wheel comprising:

a transfer wheel body provided with three slots each arranged at every 120° angle centering around a center rotating shaft hole of said transfer wheel and having a guide portion for guiding at least one of said pin trays of the bin tray;

three pairs of insert wheels, each pair comprising two types of insert wheels mounted near with each other between said slots in order to alternatively pick up and push said at least one pin tray along a slot liner of a side plate;

a mounting means for mounting said insert wheels on said transfer wheel body; and driving means for providing a rotation power for said transfer wheel body.

2. A transfer wheel of sorter as claimed in claim 1, wherein said driving means comprises a bevel gear shaft mounted on a rear surface of said transfer wheel body.

3. A transfer wheel of sorter as claimed in claim 1, wherein said driving means comprises a spur gear formed on a circumferential surface of said transfer wheel body.

4. A transfer wheel of sorter as claimed in claim 2, further comprising a spur gear formed on a circumferential surface of said transfer wheel body in order to transmit the rotation power to outside.

5. A transfer wheel of sorter as claimed in claim 3, further comprising a rotation detecting support means mounted on a rear surface of said transfer wheel body and provided with rotating position detecting slots.

6. A transfer wheel of sorter as claimed in any one of claims 1 to 3, wherein said mounting means includes insert wheel supporting shafts and springs, said springs biasing said insert wheels in a direction away from said transfer wheel body.

7. A transfer wheel of sorter as claimed in claim 6, wherein said two types of insert wheels together comprise first and second insert wheels having two types of circumferential slot arrangements.

8. A transfer wheel of sorter as claimed in claim 7, wherein said first and second insert wheels each includes an elliptic outer surface for contacting a pin tray and an elliptic inner surface for guiding a pin tray to one of said slots of the transfer wheel body.

9. A transfer wheel sorter as claimed in claim 7, wherein said first insert wheel has a rounded tail portion for guiding a pin tray to one of said slots of the transfer wheel body, and said second insert wheel has a plane tail portion connecting with said rounded tail portion of said first insert wheel.

10. A transfer wheel of sorter as claimed in claim 7, wherein said first and second insert wheels have symmetrically rounded tail portion means for guiding a pin tray to one of said slots of the transfer wheel body connecting with each other.

11. A transfer wheel of sorter as claimed in claim 8, further comprising a partition between said first and second insert wheels on said transfer wheel body in order to separate said first insert wheel from said second insert wheel.

* * * * *